US005231272A

United States Patent [19]

Mardon

[11] Patent Number: 5,231,272

[45] Date of Patent: Jul. 27, 1993

[54] STORAGE SYSTEM WITH ADJACENT LOCKERS CONTROLLED BY A MICROPROCESSOR DEVICE

[75] Inventor: Philippe Mardon, Combs-La-Ville, France

[73] Assignee: MORS, Paris, France

[21] Appl. No.: 866,103

[22] Filed: Apr. 7, 1992

Related U.S. Application Data

[63] Continuation of Ser. No. 481,177, Feb. 20, 1990, abandoned.

[30] Foreign Application Priority Data

Mar. 23, 1989 [FR] France ..... 89 03862

[51] Int. Cl.[5] ..... E05B 47/00

[52] U.S. Cl. ..... 235/382; 340/825.31

[58] Field of Search ..... 235/380, 382; 340/825.31

[56] References Cited

U.S. PATENT DOCUMENTS 3,742,453 6/1973 Poylo ..... 340/149
3,820,072 6/1974 Blum ..... 340/149
3,976,974 8/1976 Hinohara et al. ..... 340/149
4,204,635 5/1980 Hofmann et al. ..... 235/382
4,278,879 7/1981 Hofmann et al. ..... 235/380
4,912,310 3/1990 Uemura et al. ..... 235/382 X

FOREIGN PATENT DOCUMENTS 0065605 12/1982 European Pat. Off. .
2078845 1/1982 United Kingdom .
2080264 2/1982 United Kingdom .

*Primary Examiner*—John Shepperd
*Attorney, Agent, or Firm*—Kenyon & Kenyon

[57] ABSTRACT

A storage system with adjacent lockers comprising a keyboard-visualizing display screen connected to a microprocessor device and enabling an attendant to record the identity of a user; a dispenser device for delivering to the user a ticket onto which are stored at least the number of the locker assigned to the user and his identity and a device associated with each locker for receiving and reading the ticket, said system being applicable in railway stations or airports.

5 Claims, 2 Drawing Sheets

STORAGE SYSTEM WITH ADJACENT LOCKERS CONTROLLED BY A MICROPROCESSOR DEVICE

This application is a continuation of application Ser. No. 07/481,177, filed Feb. 20, 1990 now abandoned.

BACKGROUND OF THE INVENTION

The present invention relates to a storage system with adjacent lockers or like storage units closed each one by a door enabling any user to deposit objects or things, such as luggages or parcels, packages or like cases into an assigned locker as well as to withdraw these objects therefrom during a determined period of engagement of the locker.

Such a system is applicable in particular in railway stations and/or airports.

There are known such systems controlled by a microprocessor device which would bolt the lock of the door of a locker containing the objects after payment of a determined sum and which would dispense a ticket, slip or card onto which is printed in clear or plain language in particular a number of the code of identification of the locker assigned to the user. Before the end of the allowed duration of engagement of the locker the user would compose or dial by means of a keyboard the code number which is recognized by the microprocessor device then operating the unbolting or release of the lock of the door of the engaged locker.

Such a known system however is constraining for the user who has to compose or dial the number of the code of identification of the engaged locker to recover his personal objects. Moreover the user may loose his ticket or slip which may be found by persons likely to appropriate the objects left or deposited after composition of the code printed in clear or plain language on the ticket.

SUMMARY OF THE INVENTION

The present invention aims at removing the inconveniences referred to hereinabove by providing a storage system comprising a plurality of adjacent lockers which are each one closed by a door; a microprocessor device connected through the agency of a device with input-/output interfaces to locks for opening and shutting the doors of the lockers and characterized in that the microprocessor device is also connected to a keyboard-visualizing display screen unit, respectively, so as to enable an agent located at a reception desk or position to record the identity such as for instance the name, the identity card number and the passport number of a user appearing at the desk and to assign to the identity of the user a free locker number and an hourly slice or period of engagement of the locker; to a device for dispensing to the user a voucher preferably a ticket with a magnetic track into which are stored in encoded form at least the number of the locker assigned and the identity of the user; and a device for receiving and reading the voucher associated with each locker; and in that the reading device associated with the free or engaged locker assigned to the user and having received the voucher of the latter transmits at least the information relating to the number of the locker stored onto the voucher to the microprocessor device which controls whether this information actually corresponds to the locker number assigned to the user and which in the affirmative operates the unbolting or release of the lock of the door of the locker assigned to the user who would deposit therein or recover therefrom at least one personal object.

According to a another feature of the invention the reading device also conveys the information relating to the identity of the user as stored on his voucher to the microprocessor device which controls from this information whether the free or engaged locker has actually been assigned individually to the user and in the affirmative operates the unbolting or release of the lock of the door of the locker.

According to another feature of the invention the microprocessor device also controls from the aforesaid information of the reading device whether the locker assigned to the user is allotted within the aforesaid hourly slice or period of engagement.

According to still another feature of the invention the agent or attendant is recording the identity of the user by means of the keyboard-visualizing display unit at the same time as the user is paying the price of hiring or renting the locker assigned during the aforesaid hourly slice or period of engagement.

Advantageously a code relating to the hourly time slice of engagement of the locker assigned to the user is stored on the voucher which is dispensed to him.

Preferably the code relating to the number of the locker stored on the voucher is specific to the user.

According to still a further feature of the invention each locker door is brought back into closed position preferably by a resilient biassing or drawback member and the lock of this door is then bolted by the microprocessor device.

An opto-electronic sensor or detector is associated with each door lock of a locker to check the proper bolting of the lock.

The keyboard-screen unit enables the official agent in charge to retrieve or find again the number of the locker assigned to the user from its identity in particular in case of loss by the user of his voucher.

BRIEF DESCRIPTIONS OF THE DRAWINGS

For a fuller understanding of the invention, reference is made to the following description taken in conjunction with the accompanying drawings, in which.

DETAILED DESCRIPTION OF THE PREFERRED EMBODIMENT

Figure 3:
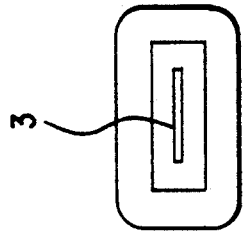
FIG. 3 is an enlarged view of the portion circled at III on FIG. 1.
Figure 1:
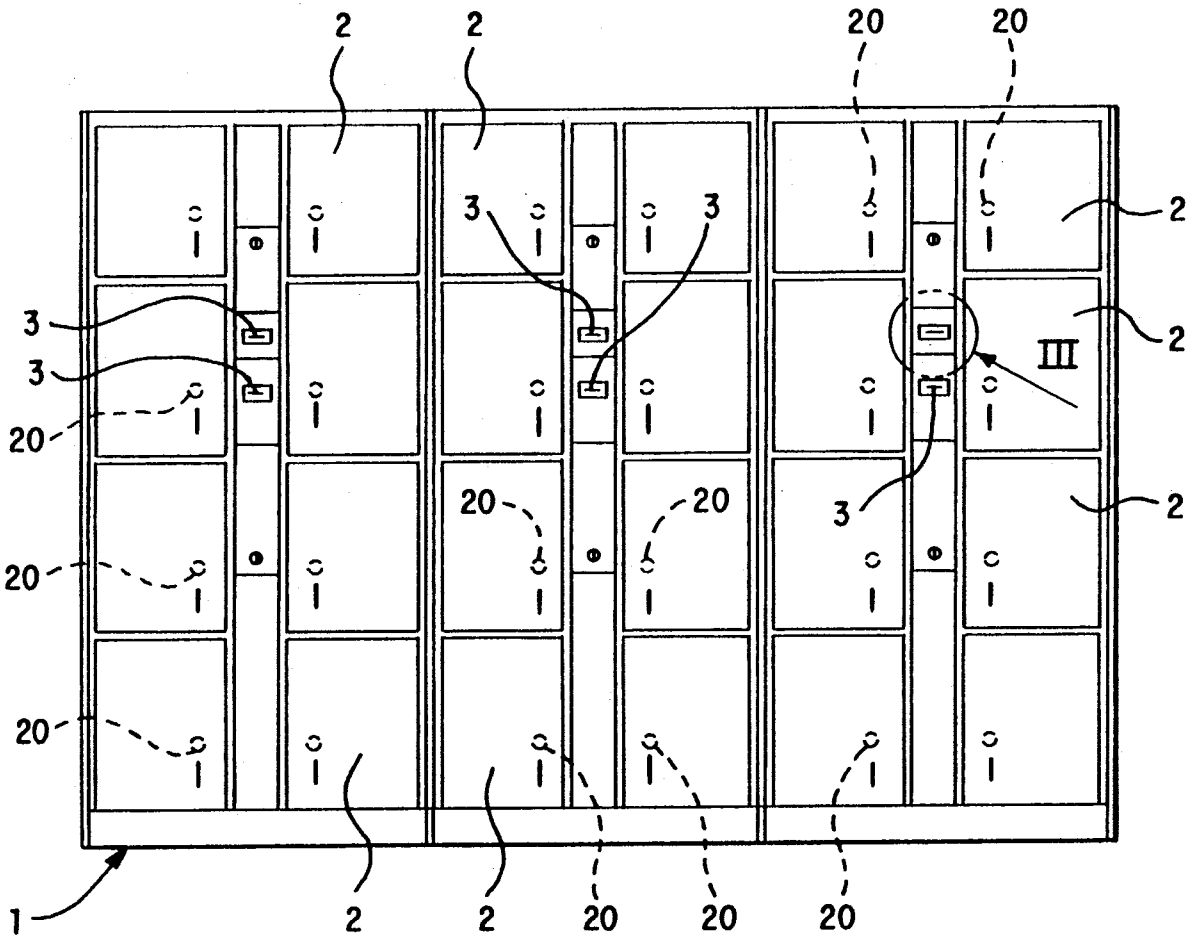
FIG. 1 is a front view of the storage system with adjacent lockers according to the invention.
Figure 2:
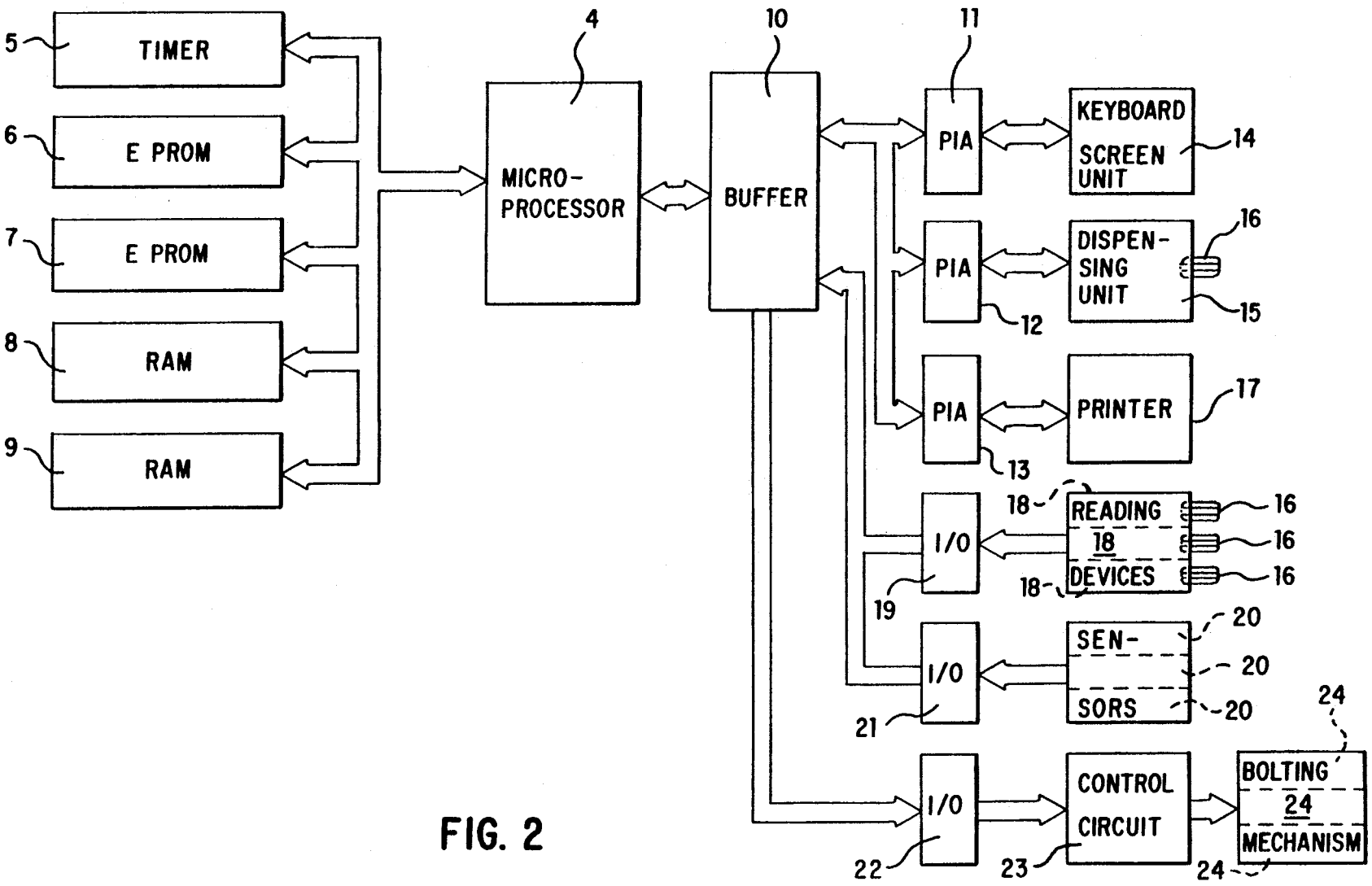
FIG. 2 shows as a block-diagram the electronic device for controlling and operating the system according to FIG. 1.

Referring to the Figures the reference numeral 1 designates a storage system with adjacent lockers in a number of twenty for instance and the doors of which in the closure position are all located in a same front plane. Each door comprises a self-acting return device automatically moving the door back into the closing shut position. Such biasing devices are already known per se and may for instance consist of a return spring arranged in coaxial relation to the hinge of the door and acting between the latter and its frame or casing. Each door also comprises a lock secured to the inside of the door and the bolting or the unbolting of which is operated by a microprocessor device such as described later herein.

On the front face of the storage system are provided openings or slots 3 for receiving a voucher, preferably consisting of a ticket with a magnetic track, each slot 3 forming a part of a voucher-reading device. A reading device is associated with each locker 2.

The microprocesseur device providing for the operation of this storage system 1 comprises a microprocessor 4 bidirectionally connected to a time base or timer 5, an EPROM (erasable programmable read-only) memory or store 6 containing the operating program of the microprocessor 4, an EPROM memory or store 7 into which are stored or entered various parameters such in particular as time values of the time base or timer 5, and two read-write memories of the RAM type 8 and 9 allowing to respectively store data relating to numbers of lockers assigned to utilizers or users and data relating to the identity of these users.

The microprocessor 4 is also bidirectionally connected through the medium of a buffer circuit or buffer 10 to three circuits with parallel inputs/outputs interfaces 11–13 such for instance as the PIA (peripheral interface adapter) circuit known per se. The interface circuit 11 is bidirectionally connected to a keyboard-screen unit 14 whereas the interface circuit 12 is bidirectionally connected to a device 15 for dispensing tickets 16. The interface circuit 13 is bidirectionally connected to a printer 17.

The microprocessor 4 receives through the agency of the buffer circuit 10 information from the devices 18 for reading the tickets 16 associated with the lockers 2, respectively. The reading devices 18 are connected to the buffer circuit 10 through the medium of an interface circuit 19. The microprocessor 4 also receives information from the sensors 20 detecting the proper closure of the doors of the lockers 2 in particular upon the step of depositing objects and consisting for instance of opto-electronic sensors accommodated either in the stile of the door in the case where the lock is made fast with the door or within the door in the case where the lock is fastened to the stile. The sensors 20 are connected to the buffer circuit 10 through the agency of an interface circuit 21. At last the microprocessor 4 is transmitting through the medium of an interface circuit 22 and of a control or drive circuit 23 information for operating mechanisms 24 for bolting and unbolting locks of the doors of the lockers 2. Such mechanisms may consist of electromechanical operating members for actuating the lock bolts or of motors or like power appliances the activation direction of which would determine the bolting or the unbolting of the lock.

The operation of the storage system according to the invention will now be set forth hereinafter.

A user presents himself at the receiver position or desk where is an official agent in charge able to talk or converse with the microprocessor 4 through the medium of the keyboard-screen unit 14. The user asks for the use of a locker 2 by stating to the official agent in charge his identity such for instance as his surname, his identity card number, his passport number and so on. The agent would tap out on his keyboard the identity of the user who would at the same time pay for the renting or hiring of the locker. The microprocessor 4 upon receiving the information relating to the identity of the user would assign to this information a free locker number as well as a predetermined hourly slice or period of engagement of the locker. Thus the microprocessor 4 would store in the memories 7–9 the data relating to the hourly slice or period of engagement of the locker, to the locker number assigned to the user and to the identity of the user. The microprocessor 4 would also convey these data to the unit 14 so as to be displayed or visualized thereon. Moreover the microprocessor 4 would operate the dispenser device 15 so that it dispenses a ticket 16 onto which are magnetically stored the number of the locker assigned to the user as well as his identity. On the dispensed ticket 16 may also be magnetically recorded the hourly slice or period of engagement of the locker assigned to the user. It should be pointed out that the assignment of a locker may be carried out automatically by the microprocessor 4 which under the control of a routing program would seek among the lockers 2 a free locker or upon the request of the user the microprocessor 4 then checking or ascertaining whether the selected locker is actually free.

The user would take hold of his ticket 16 and would proceed to the closed locker 2 which has been assigned to him, such a locker being individually and visually identified by its number. Preferably the assignment of the allocated locker number to the user is carried orally by the official agent in charge but it is also possible to provide in association with the dispensing device 15 a device for printing in clear onto the dispensed ticket 16 the number of the locker assigned to the user. The latter would then insert his ticket into the slot 3 of the reading device 18 associated with the locker 2 which has been assigned to him. The reading device 18 would read at least the information relating to the locker number stored onto the ticket and would convey it to the microprocessor 4 which would control whether this information actually corresponds to the locker number assigned to the user. The number of a locker may be magnetically encoded differently onto each ticket dispensed by the device 15 to each user or be a same magnetic code for all the tickets dispensed. In the latter case it is preferable that the reading device 18 also reads the information relating to the identity of the user stored onto his ticket and carries it to the microprocessor 4 which would check or ascertain whether the free locker has actually been assigned personally to the free locker has actually been assigned personally to the user during the hourly slice or period of engagement which has been ascribed to him. This thus allows to more personalize a ticket delivered to the user. The recognition by the microprocessor 4 of the hourly slice of engagement of the locker assigned to the user may be effected from data stored into the memory 7 in relation to those stored into the memories 8 and 9 or by also magnetically recording onto each ticket dispensed an information relating to the hourly range which is then read by the reading device 18 which would transmit to the microprocessor 4 the corresponding information in order to check whether the hourly range ascribed to the user together with the code number of the assigned locker have actually been assigned to the identity of the user.

After having checked the truthfulness of the information recorded into the ticket 16 inserted into the reader 18 the microprocessor 4 conveys to the mechanism or appliance 24 an order or instruction of unbolting the lock of the door of the assigned locker so as to enable the user to put his objects into the open locker. After having laid down his objects therein the user would shut again the door of the locker which is automatically urged towards its closing position. The proper bolting of the door lock of the locker is detected by the associated opto-electronic sensor 20. If a difficulty of bolting the lock of the door arises the microprocessor 4 after having received from the sensor 24 the corresponding defect or anomaly information would send to the screen of the unit 14 an information advising the official agent in charge or attendant of this anomaly. In such a situation the microprocessor 4 may also be adapted to send an information to a sound signalling and/or visual warning device located near the attendant. Once the cause of the difficulty of bolting the lock of the door has been removed and the door has been properly closed the object is enclosed or locked within the assigned locker for a determined hourly duration or time range of engagement. The reading device 18 is designed to then return to the user his ticket 16.

When the user wishes to withdraw his personal objects before the end of the duration of engagement of the assigned locker he would insert his personalized ticket into the reading device 18 which would read it and transmit at least the information relating to the number of the locker memorized into the ticket to the microprocessor 4 as already stated hereinabove. Thus the microprocessor 4 would control or check the information or data recorded into the ticket 16 in the same manner as upon putting objects into the locker. Once the truthfulness of the information contained on the ticket 16 has been checked the microprocessor 4 would send to the mechanism 24 an order or instruction for unbolting the lock of the door of the engaged locker thereby triggering the opening of the door. The user would recover his personal objects, the door of the locker would shut by moving automatically into the closing position and the lock would be bolted by the microprocessor 4 operating the mechanism 24 after a predetermined time delay. If the door is not locked after the lapse of this time delay for instance in case of an anomaly an alarm would be released at the receiver desk or position.

If the user tries to recover his personal objects outside of the hourly slice of engagement which has been ascribed to him the reading device 18 under the control of the microprocessor 4 is designed to keep or retain the ticket of the user thereby compelling the latter to proceed to the receiver desk or position where the attendant would inform him accordingly. For instance the user may by omission or forgetting have let lapse the duration of engagement of the locker which has been assigned to him. In this case the attendant would give him back his personal objects against the payment of a determined fee and after having checked his identity by means of the keyboard-screen unit 14.

The user may of course be led to withdraw some of his objects left in the locker during the hourly period of engagement and to leave others in the locker. In such a case the reading device 18 will give him the ticket back to enable him to later recover the objects remaining left in the locker.

In case of loss by the user of his ticket, the latter would proceed to the desk or position by stating his identity to the attendant which may then retrieve through the unit 14 the number of the locker assigned to the user.

The system according to the invention thus allows to provide for the identification of the user authorized to use a given locker for a given duration of engagement of the locker.

Onto each dispensed ticket 16 it is also possible to print in clear other information relating in particular to the identity of the user or to the hourly slice or period of engagement of the assigned locker.

The dispensing device 15 and the devices 18 for reading tickets 16 are already known per se and are of a current use for other applications. Therefore they have not to be described more in detail. At last the printer 17 allows for instance to enter the daily list of the users having hired or rented a determined locker thereby enabling the attendant to quickly check whether a locker called for by a user is or is not already engaged without having to go through the microprocessor device.

What is claimed is:

1. A storage system used in railway stations or airports comprising a plurality of adjacent lockers which are each one closed by a door; a microprocessor device connected through the medium of a device with input/output interfaces to locks for opening and shutting doors of the lockers; wherein said microprocessor device is also connected to a keyboard-displaying screen unit so as to enable an attendant located at a receiver desk to record the identity such as the surname, the identity card number or the passport number of a user presenting himself to the receiver position and to assign to the identity of the user a free locker number and an hourly slice of engagement of the locker while at the same time the user pays to the attendant the amount of the rent of the locker assigned to the user; to a dispensing device delivering to the user a ticket with a magnetic track into which are stored in encoded form at least the number of the assigned locker, the identity of the user and the hourly slice of engagement of the locker assigned to the user; and to a device for receiving and reading the ticket associated with each locker so that a reading device is associated with each locker; the reading device associated to the free or engaged locker assigned to the user and having received the ticket of the latter is transmitting the information relating to the number of the locker, the identity of the user and said hourly slice of engagement of the assigned locker stored into the ticket to the microprocessor device which would check whether this information corresponds actually to the locker number assigned to the user and the locker assigned to the user is allocated within said hourly slice of engagement and which in the affirmative would operate directly the unbolting of the lock of the door of the locker assigned to the user who is depositing therein or recovering therefrom at least one personal object; said reading device is giving back to the user his ticket after deposit of his personal object into the locker; and wherein the locker door is returned into shut position by a resilient biasing member and the microprocessor device is then bolting the lock of the locker door.

2. A system according to claim 1, wherein said number of said locker may be magnetically encoded differently onto each ticket for each user.

3. A system according to claim 1, further comprising an opto-electronic sensor associated with each door lock of a locker to control the proper bolting of the lock.

4. A system according to claim 1, wherein said ticket also comprises information printed in clear and relating in particular to the identity of the user, to the number of the locker which has been assigned to him and/or to the hourly slice engagement.

5. A system according to claim 1, wherein said keyboard-screen unit enables the attendant to retrieve the number of the locker assigned to the user from his or her identity in particular in case of loss by the user of his or her ticket.

* * * * *

UNITED STATES PATENT AND TRADEMARK OFFICE

CERTIFICATE OF CORRECTION

PATENT NO. : 5,231,272

DATED : 27 July 1993

INVENTOR(S) : Philippe MARDON

It is certified that error appears in the above-indentified patent and that said Letters Patent is hereby corrected as shown below:

| Column | Line | |
|---|---|---|
| 2 | 3 | Before "another" delete "a". |
| 4 | 40 | Delete "to the free locker has". |
| 4 | 41 | Delete "actually been assigned personally". |

Signed and Sealed this

Seventeenth Day of May, 1994

Bruce Lehman

*Attest:*

BRUCE LEHMAN

*Attesting Officer*

*Commissioner of Patents and Trademarks*